US010657947B2

(12) United States Patent
Zalewski et al.

(10) Patent No.: US 10,657,947 B2
(45) Date of Patent: May 19, 2020

(54) INTEGRATED BROADBAND ACOUSTIC ATTENUATOR

(71) Applicant: ZIN TECHNOLOGIES, INC., Middleburg Heights, OH (US)

(72) Inventors: Bart F. Zalewski, Lakewood, OH (US); William B. Dial, Cuyahoga Falls, OH (US); Arthur J. Birchenough, Berea, OH (US)

(73) Assignee: ZIN TECHNOLOGIES, INC., Middleburg Heights, OH (US)

( * ) Notice: Subject to any disclaimer, the term of this patent is extended or adjusted under 35 U.S.C. 154(b) by 291 days.

(21) Appl. No.: 15/673,501

(22) Filed: Aug. 10, 2017

(65) Prior Publication Data

US 2019/0051281 A1 Feb. 14, 2019

(51) Int. Cl.

| | |
|---|---|
| ***G10K 11/172*** | (2006.01) |
| ***E04B 1/84*** | (2006.01) |
| ***G10K 11/168*** | (2006.01) |
| *G10K 11/16* | (2006.01) |
| *E04B 1/82* | (2006.01) |

(52) U.S. Cl.

CPC ..... *G10K 11/168* (2013.01); *G10K 11/172* (2013.01)

(58) Field of Classification Search

CPC ..... G10K 11/172; G10K 11/16; E04B 2001/8433; E04B 2001/848; E04B 2001/8485; E04B 2001/849; E04B 2001/8495; E04B 2001/8476

See application file for complete search history.

(56) References Cited

U.S. PATENT DOCUMENTS

| | | | | |
|---|---|---|---|---|
| 1,969,704 A | | 8/1934 | D'Alton | |
| 2,989,136 A | * | 6/1961 | Wohlberg | G10K 11/172 181/224 |
| 4,068,736 A | | 1/1978 | Dean et al. | |

(Continued)

FOREIGN PATENT DOCUMENTS

| | | | | |
|---|---|---|---|---|
| DE | 1111799 B | * | 7/1961 | E04B 1/86 |
| WO | 2006118443 | | 11/2006 | |
| WO | 2006118443 A1 | | 11/2006 | |

OTHER PUBLICATIONS

Li, D., "Vibroacoustic Behavior and Noise Control Studies of Advanced Composite Structures"; Dissertation, University of Pittsburgh, Jul. 16, 2003; 166 pp.

(Continued)

*Primary Examiner* — Edgardo San Martin
(74) *Attorney, Agent, or Firm* — Tarolli, Sundheim, Covell & Tummino LLP

(57) ABSTRACT

An acoustic attenuation assembly includes a low frequency sound attenuation device having at least one sound attenuation chamber containing a volume and mass of air. First and second openings are associated with each low frequency chamber through which excited air resonates. The first and second openings extend through the first sheet into each low frequency chamber. Each chamber has an open side. A high frequency sound attenuation device is secured to the low frequency attenuation device and closes the open side of each chamber. The high frequency sound attenuation device includes a plurality of projections formed from a sound absorbing material that absorbs excited air.

22 Claims, 9 Drawing Sheets

(56) References Cited

U.S. PATENT DOCUMENTS 4,170,674 A * 10/1979 Matsuki ..... B31F 1/2822 428/90
4,971,850 A * 11/1990 Kuan-Hong ..... E04B 1/86 181/284
5,362,931 A * 11/1994 Fries ..... G10K 11/172 181/284
5,512,715 A * 4/1996 Takewa ..... E04B 1/86 181/286
5,719,359 A * 2/1998 Wolf ..... G10K 11/172 181/286
5,854,453 A * 12/1998 Fujiwara ..... E01F 8/0058 181/293
5,930,371 A * 7/1999 Cheng ..... F01N 1/023 381/71.5
5,959,265 A * 9/1999 Van Ligten ..... G10K 11/172 181/286
5,996,731 A 12/1999 Czabala et al.
6,069,840 A 5/2000 Griffin et al.
6,231,710 B1 5/2001 Herup et al.
6,382,931 B1 5/2002 Czabala et al.
6,532,296 B1 3/2003 Vaudrey et al.
6,568,135 B1 * 5/2003 Yokoyama ..... E01F 8/0094 181/208
6,892,856 B2 * 5/2005 Takahashi ..... G10K 11/172 181/284
7,837,008 B1 11/2010 Lane et al.
7,885,418 B1 2/2011 Hallman
7,902,944 B2 3/2011 Fukunaga
7,913,813 B1 * 3/2011 Mathur ..... G10K 11/172 181/290
8,006,802 B2 * 8/2011 Honji ..... G10K 11/172 181/293
8,210,308 B2 7/2012 Penner et al.
8,631,901 B2 * 1/2014 Honji ..... E04B 1/86 181/293
9,097,220 B2 8/2015 Ostler et al.
9,369,805 B2 6/2016 Wilson
9,378,721 B2 6/2016 Zalewski et al.
9,697,817 B2 * 7/2017 Zalewski ..... G10K 11/172
2019/0172437 A1 * 6/2019 Zalewski ..... G10K 11/168

OTHER PUBLICATIONS

Li, D., Vand Vipperman, J.S., On the Design of Long T-Shaped Acoustic Resonators, Acoustical Society of America, 116(5), pp. 2785-2792, Nov. 2004.

Esteve, S. J., Control of Sound Transmission into Payload Fairings Using Distributed Vibration Absorbers and Helmholtz Resonators, Virginia Polytechnic Institute and State University, Blacksburg, Virginia, May 6, 2004; 255 pp.

Li, D. and Vipperman, J.S., On the Noise Transmission and Control for a Cylindrical Chamber Core Composite Structure, Journal of Sound and Vibration, 288 pp. 235-254, Mar. 17, 2005.

Lane, S.A., Richard, R.E., and Kennedy, S. J., "Fairing Noise Control Using Tube-Shaped Resonators", Journal of Spacecraft and Rockets. 42(4), pp. 640-646, Jul. 2005.

Li, D., Cheng, L., Yu, G. H., and Vipperman, J.S., "Noise Control in Enclosures: Modeling and Experiments with T-Shaped Acoustic Resonators", Acoustical Society of America, 122(5), pp. 2615-2625, Nov. 2007.

Floody, S.E, Venegas, R., and Leighton, F.C., "Optimal Design of Slit Resonators for Acoustic Normal Mode Control in Rectangular Room", Proceedings of the COMSOL Conference, Paris, Nov. 2010.

* cited by examiner

INTEGRATED BROADBAND ACOUSTIC ATTENUATOR

TECHNICAL FIELD

This disclosure relates generally to acoustic attenuation and, more specifically, relates to an integrated, tunable high and low frequency acoustic attenuator.

BACKGROUND

Current mitigation technologies of low frequency spectrum attenuation include acoustic hangers, Helmholtz resonators, chamber core resonators, coverage tube resonators, large volume resonators, and large mass systems. In tube resonators, the frequency is dictated by the length of the chamber(s) therein, which can be limited where size constraints exist. Consequently, an individual tube resonator is not broad band, i.e., the device operates in a narrow frequency range. However, multiple resonators can be tuned to different frequencies by adjusting their lengths such that an assembly of resonators can provide broad band attenuation.

SUMMARY

This disclosure relates generally to integrated high and low frequency acoustic attenuation. As one example, an acoustic attenuation assembly includes a low frequency sound attenuation device having at least one sound attenuation chamber containing a volume and mass of air. First and second openings are associated with each low frequency chamber through which excited air resonates. The first and second openings extend through the first sheet into each low frequency chamber. Each chamber has an open side. A high frequency sound attenuation device is secured to the low frequency attenuation device and closes the open side of each chamber. The high frequency sound attenuation device includes a plurality of projections formed from a sound absorbing material that absorbs excited air.

As another example, an acoustic attenuation assembly includes a low frequency sound attenuation device extending from a first end to a second end and having first and second sheets. A plurality of webs positioned between the sheets cooperates with the sheets to form at least one low frequency sound attenuation chamber containing a volume and mass of air. Each chamber has an open side. A first panel is secured to the sheets and closes the low frequency chambers at the first end of the device. A second panel is secured to the sheets and closes the low frequency chambers at the second end of the device. First and second openings are associated with each low frequency chamber through which excited air resonates. The first and second openings extend through the first sheet into each low frequency chamber. A high frequency sound attenuation device includes a plurality of projections. The high frequency attenuation device is formed from a sound absorbing material that absorbs excited air. The high frequency sound attenuation device is secured to the low frequency sound attenuation device to close the open end of each chamber.

DETAILED DESCRIPTION

This disclosure relates generally to acoustic attenuation and, more specifically, relates to an integrated, tunable high and low frequency acoustic attenuator. The device can be used to attenuate a predetermined (broadband) range of frequencies where either large volume resonators or large mass systems are traditionally used.

The assembly mitigates low frequency acoustic noise, e.g., below about 160 Hz, by utilizing acoustic chambers, each with one or more openings, which act as resonators and allow molecules of a fluid therein to vibrate through the openings. The assembly mitigates high frequency acoustic noise, e.g., above about 160 Hz, by absorbing and/or impeding the fluid molecules. In one example, the assembly includes a low frequency sound attenuation device having at least one sound attenuation chamber through which excited air resonates and a high frequency sound attenuation device secured to the lower frequency sound attenuation device that includes projections formed from sound absorbing material for absorbing excited air. While the examples disclosed herein describe the fluid as air, it is understood that any fluid or combination of fluids can reside within the chambers and/or be absorbed, which can depend on the environment where the attenuator device is used. Thus, the fluid can be any substance that flows, which can include liquids, e.g., water, oil, gasoline, and/or gases, e.g., air or its constituents.

In the case of low frequency acoustics, the initially stationary air inside of a chamber is excited by a pressure wave and moves outside of the chamber through an opening. As the air exits, it creates a pressure difference between the inside and outside of the chamber, thereby forcing the air to move back inside the chamber through the same opening. The air continues to vibrate through the opening at the chamber's resonant frequency, analogue to a tuned mass damper, which dissipates acoustic energy. In the case of high frequency acoustics, the excited air passes over sound absorbing material connected to the chambers.

Figure 1:
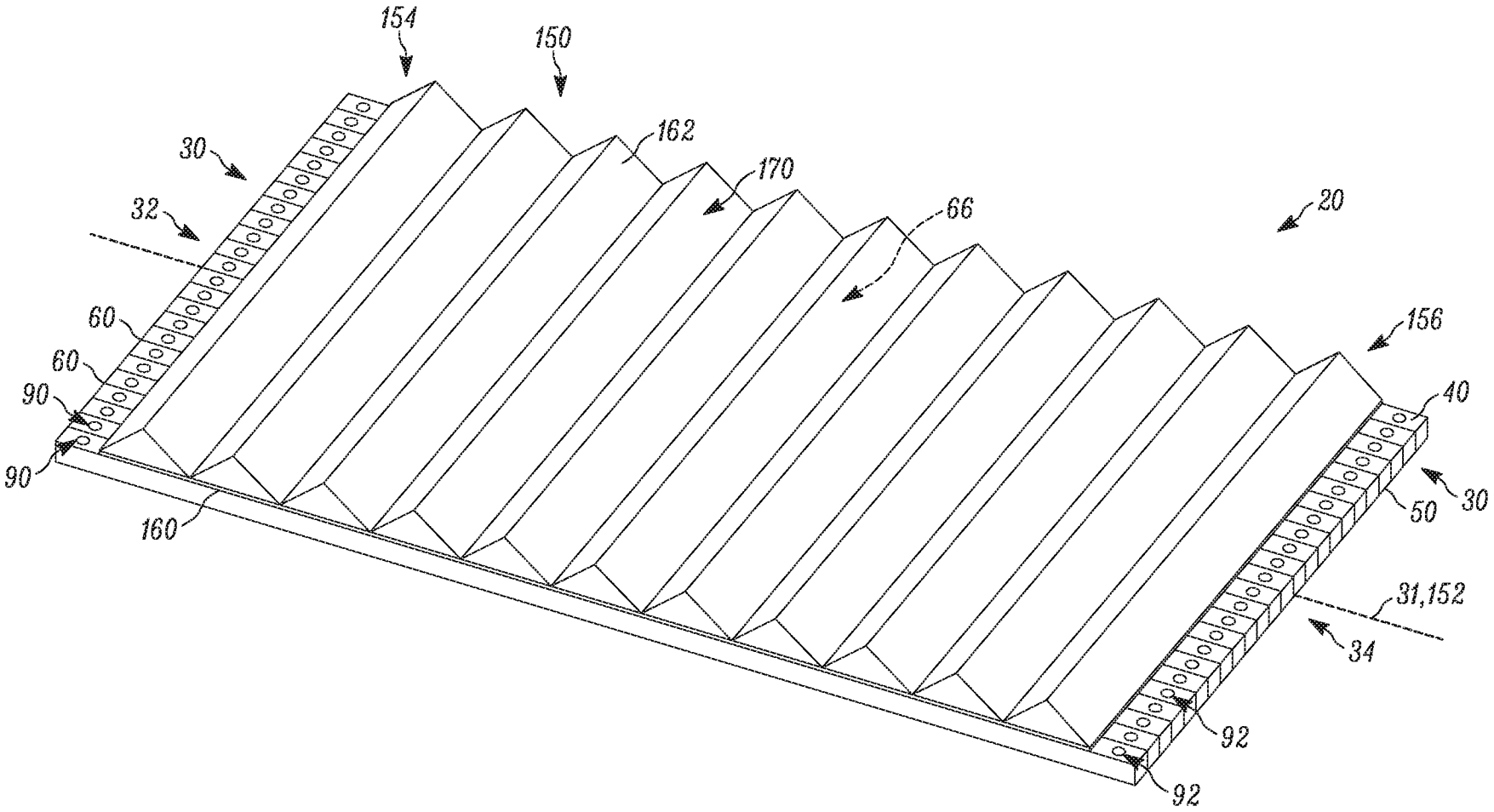
FIG. 1 illustrates an example acoustic attenuator assembly.
Figure 2:
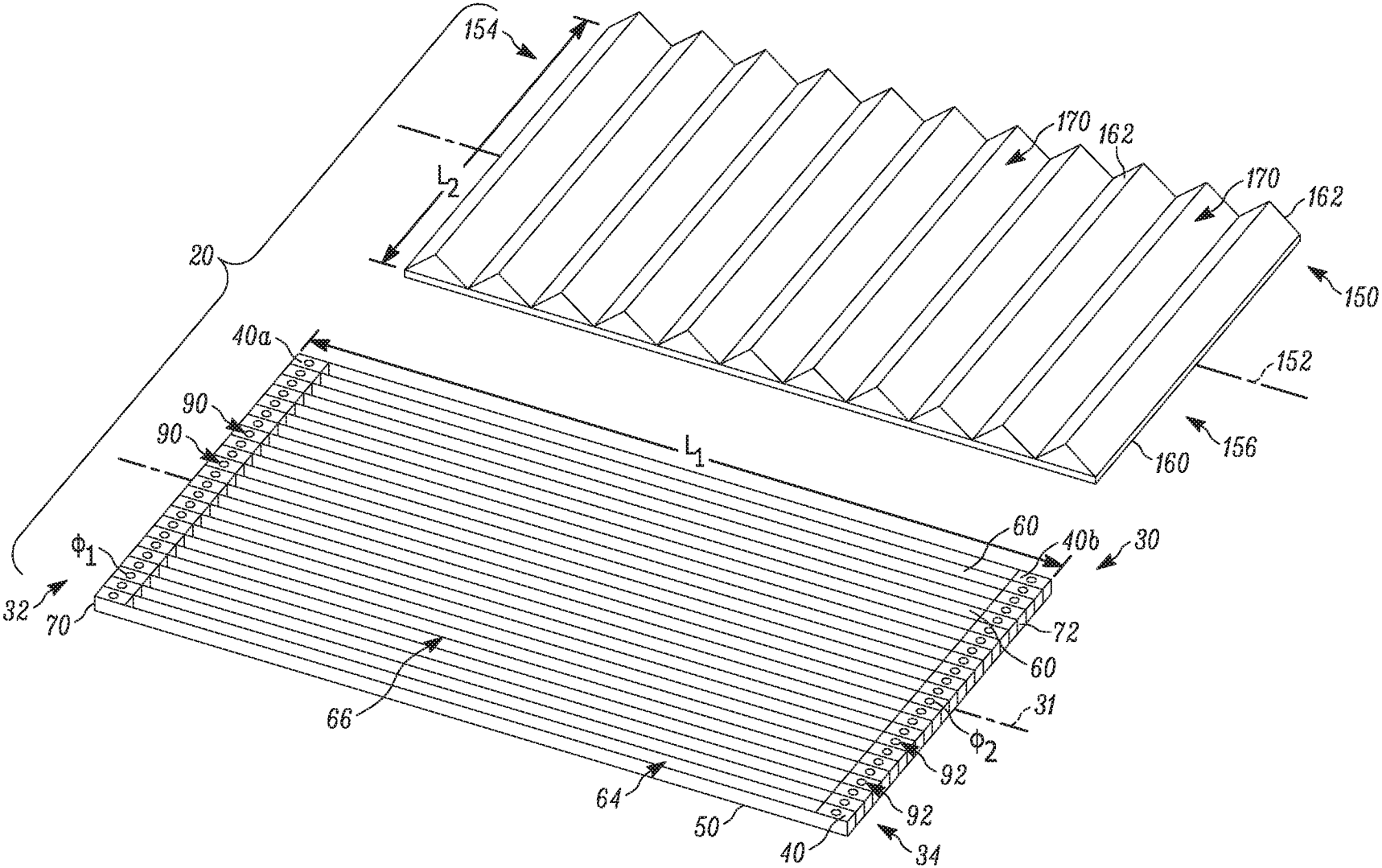
FIG. 2 illustrates an exploded view of the assembly of FIG. 1 showing high and low frequency sound attenuation devices.

FIGS. 1-2 illustrate an example acoustic attenuation assembly (or resonator) 20. The assembly 20 includes a low frequency sound attenuation device 30 and a high frequency sound attenuation device 150. The device 30 extends along a centerline or axis 31 from a first end 32 to a second end 34. The device 30 includes a first panel or sheet 40 and a second panel or sheet 50 that are each substantially planar. The first sheet 40 is defined by two spaced-apart portions 40*a*, 40*b*. The second sheet 50 is defined by a single component. The first and second sheets 40, 50 can have substantially the same length $L_1$ as one another. The first and second sheets 40, 50 can be parallel to one another or can extend at angles relative to one another (not shown). Although the sheets 40, 50 are illustrated in FIG. 1 as being planar and extending parallel to one another, in other examples, either or both sheets can be curved or contoured in one or more directions (not shown).

As used herein, the term "substantially" is intended to indicate that while the property or condition modified by the term can be a desirable property or condition, some variation can occur. In this context, for example, the term "substantially planar" demonstrates that the panel or sheet can be a flat sheet, although it can exhibit some minor curves, protrusions or other variations apart from being completely flat.

The first and second sheets 40, 50 are spaced apart from one another by a plurality of webs 60 (FIG. 2) extending longitudinally along or substantially parallel to the centerline 31. The webs 60 can also extend at an angle(s) relative to one another and/or be curved in one or more directions (not shown). The webs 60 cooperate within the first and second sheets 40, 50 to define a plurality of low frequency sound attenuation chambers 64 within the device 30 between adjacent pairs of webs and extending along and parallel to the centerline 31. In one example, the second sheet has a thickness of about ½". The chambers 64 can have a width $w_c$ (see FIG. 4) of, for example, about 2" or about 4".

The space between the portions 40*a*, 40*b* along the centerline 31 and between the outermost webs 60 in a direction perpendicular to the centerline define an opening 66. A portion of each web 60 in the device 30 is therefore exposed through the opening 66, as shown in FIG. 2. Consequently, each chamber 64 in the device 30 has an exposed or open side (the top side as shown in FIG. 2).

Each chamber 64 has a substantially rectangular cross-section, although alternative cross-sectional shapes are contemplated. It will also be appreciated that any chamber 64 can have a constant cross-section or a cross-section that varies along the length of the chamber. In any case, the chambers 64 define a predetermined volume and mass of fluid that resonates upon excitation. An end panel or panels 70 closes the chambers 64 at the first end 32 of the device 30. An end panel or panels 72 closes the chambers 64 at the second end 34 of the device 30. The end panels 70, 72 extend parallel to one another such that the chambers 64 can each have the same length $L_1$. In another example (not shown), the device 30 is configured to have a non-rectangular shape, e.g., triangular or trapezoidal, such that the chambers 64 have different lengths. Regardless, the end panels 70, 72 and sheets 40, 50 are hermetically sealed to one another.

The thickness of each web 60 and each sheet 40, 50 can be adjusted such that each chamber 64 has a predetermined cross-section, which may be constant or vary along each chamber. In other words, any portion of each web 60 and/or each sheet 40, 50 can have a variable thickness relative to any other portion of that web and/or sheet.

A series of first openings 90 extends through the portion 40*a* of the first sheet 40 at the end 32 of the device 30 for providing a fluid communication pathway through the portion 40*a* between the chambers 64 and ambient conditions outside the device 30. Each first opening 90 can have any shape, e.g., round, square or polygonal, and be sized the same as or different from any other first opening. As shown in the example of FIG. 2, each first opening 90 is round and has the same diameter $d_1$ as every other first opening. The size and shape of the first openings 90 is fixed or invariable once the device 30 is fully assembled.

A series of second openings 92 extends through the portion 40*b* of the first sheet 40 at the end 34 of the device 30 for providing additional fluid communication pathway through the second portion 40*b* between the chambers 64 and ambient or the environment outside the device 30. Each second opening 92 is associated with one of the first openings 90 such that each chamber 64 has an associated first opening and second opening fluidly connecting the chamber through the first sheet 40 with the ambient conditions outside the device 30.

It will be appreciated that both openings 90, 92 associated with each chamber 64 can be located on the same portion 40*a*, 40*b*. In other words, all the openings 90, 92 can be positioned at one end 32 or 34 of the device 30. In this construction, the portion 40*a*, 40*b* free of openings 90, 92 can be omitted such that the opening 66 extends from the portion 40*a* or 40*b* present to the opposite end of the device 30 (not shown).

Each second opening 92 can be round, square or have any other shape. The second openings 92 can be the same as one another for each chamber 64 (as shown) or can be different from one another in the same chamber or across different chambers.

In one example, the chambers 64 are configured to have a frequency spacing of about 3 Hz relative to one another to help limit the effects of anti-peak on the sound attenuation. In this configuration, each second opening 92 is different from other second openings 92. Each individual second opening 92, jointly with first opening 90, results in different resonant frequency of each individual chambers 64. In one example, each individual second opening 92 has a permanent, prescribed opening such that the resonant frequency of each chamber 64 is fixed.

Figure 3A:
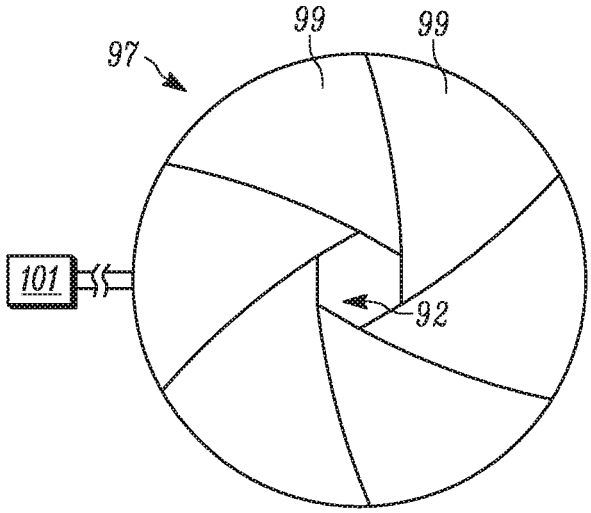
FIG. 3A illustrates a top view of an example adjustable opening in the low frequency sound attenuation device of FIG. 2 in a first condition.
Figure 3B:
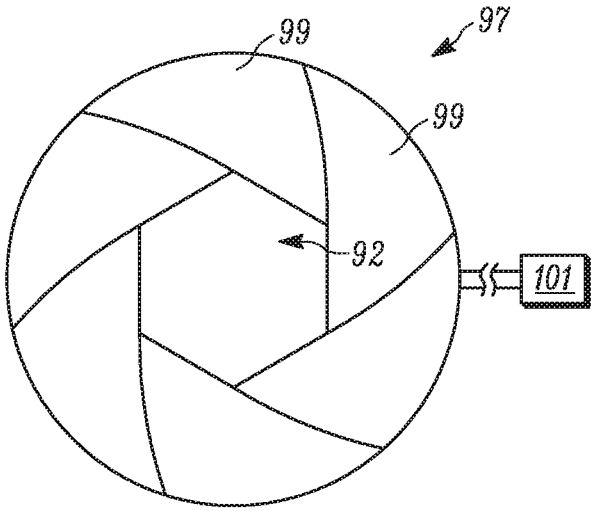
FIG. 3B illustrates a top view of an example adjustable opening in the low frequency sound attenuation device of FIG. 2 in a second condition.

In other examples, the second openings 92 differ from the first openings 90 in that the cross-section of the second openings is passively or actively adjustable. Referring to FIGS. 3A-3B, a frequency tuning mechanism 97 is associated with each second opening 92 for adjusting the amount of air that can flow through the second opening. As one example, the mechanism 97 includes a series of retractable and extendable leaves 99 that operate in a manner similar to a camera shutter in order to adjust the cross-section of the second opening 92. The spacing of a radially inner edge of the leaves 99 from the center of the associated second opening 92 is variable to change the size and shape of each second opening. The leaves 99 therefore also move relative to one another to change the spacing therebetween. The leaves 99 can have any desired size and shape to define the second openings 92, e.g., generally triangular or fin-shaped as shown. The mechanism 97 alternatively can include sliding or pivoting doors that cover varying degrees of the openings 92 (not shown).

The mechanism 97 can be associated with each second opening 92 in any number of ways, e.g., connected to the top and/or bottom of the portion 40*b* of the first sheet 40 adjacent each second opening or provided in a recess in the portion 40*b* of the first sheet surrounding each second opening. The mechanism 97 can be integrally formed with the portion 40*b* of the first sheet 40 or a separate component secured thereto.

A controller 101 or other means is electrically connected to the mechanism 97 to facilitate operation of all mechanisms. FIG. 3A shows a first condition of one mechanism 97, in which the leaves 99 are extended radially towards one another and towards the center of the second opening 92 to reduce the cross-section of the second opening. As a result, the frequency of the chamber 64 is decreased.

FIG. 3B shows a second condition of the mechanism 97, in which the leaves 99 are retracted radially away from the center of the second opening 92 to increase the cross-section of the second opening. As a result, the frequency of the chamber 64 is increased. Since the second openings 92 can have any shape, it will be understood that the leaves 99 of the associated mechanism 97 are configured to form the desired shape and size for each second opening.

The mechanism 97 enables active or dynamic frequency tuning for the device 30. In an active resonator, the size of the first openings 90 is fixed and the sizes of the second openings 92 dynamically varies, depending on the desired frequency for the particular chamber 64. For example, the controller 101 responds to user input or signal from one or more sensors (not shown) in the device 30 and actuates the leaves 99 to actively vary the size of one or more second openings 92. In this way, the controller 101 can adjust each opening to the same or different sizes depending on the frequency content of the acoustic source being attenuated. The mechanism 97 can control the leaves 99 either passively or actively to adjust the cross-sections of the second openings 92. Consequently, the size of any second opening 92 can be independently varied to specifically tailor resonant frequencies of the device 30.

Figure 4:
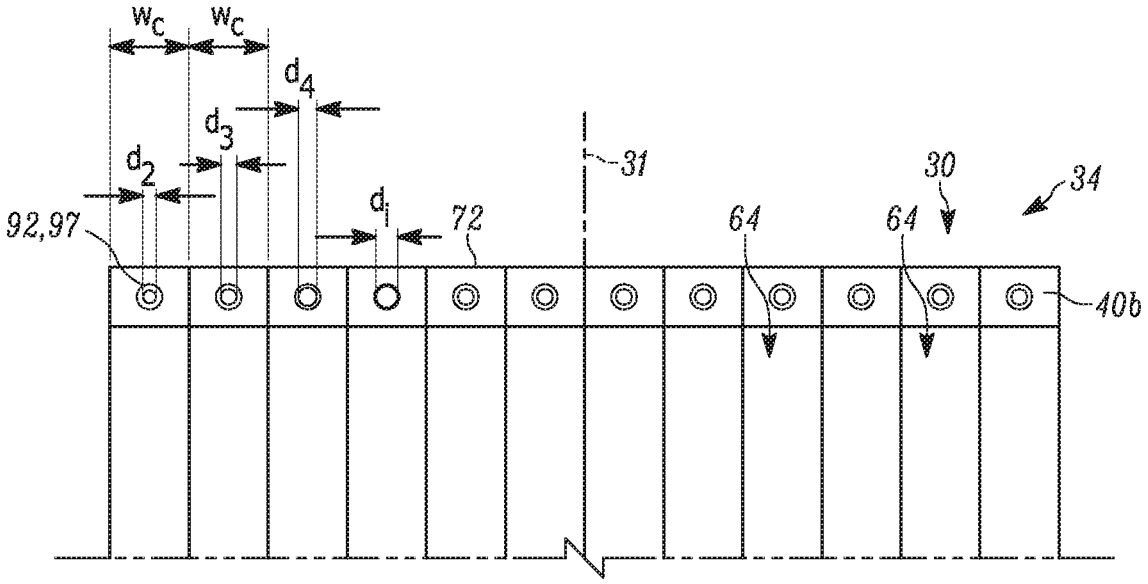
FIG. 4 illustrates a top view of a portion of the low frequency sound attenuation device including adjustable openings.

In some examples, each of the second openings 92 are individually tuned to the same or different cross-sections to provide desired attenuation for one or more frequency ranges. In FIG. 4 for instance, the mechanisms 97 define second openings 92 having different cross-sections $d_2$, $d_3$, $d_4$ from one another. In other examples, the cross-sections $d_2$, $d_3$, $d_4$ of the second openings 92 may be adjusted together and to the same cross-section. Once the size(s) of the second openings 92 have been set, they may be fixed to such size, e.g., by applying an adhesive, a locking mechanism or the like to the leaves 99. In other examples, the leaves 99 may remain movable relative to one another and thereby adjustable to enable future tunability of the second openings 92.

Figure 5:
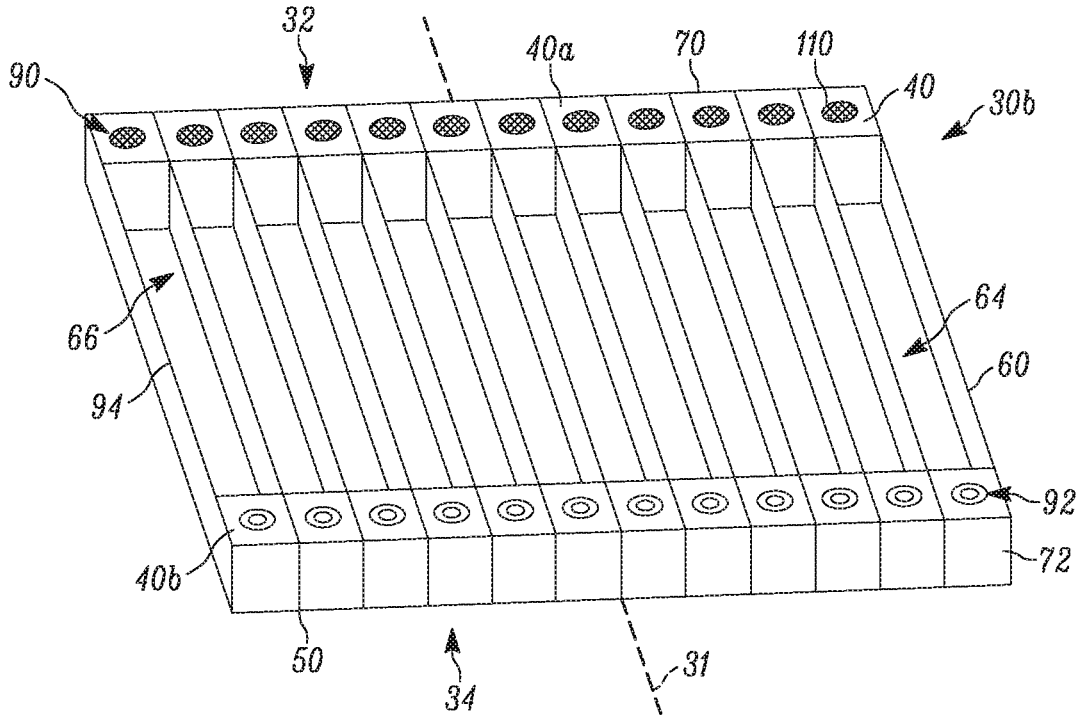
FIG. 5 illustrates the low frequency sound attenuation device of FIG. 2 with mesh over some openings.

FIG. 5 illustrates another device 30*b* in which at least some of the first openings 90 are covered by mesh 110. As shown, every first opening 90 is covered by mesh 110, although it will be appreciated that fewer first openings can be covered (not shown). The mesh 110 can be a three-dimensional printed component integral with the portion 40*a* of the first sheet 40 or can be added, e.g., via ultrasonic welding, adhesive or other means of affixation, after the remainder of the device 30*b* is manufactured. The mesh 110 provides damping and widens the frequency range over which each chamber 64 attenuates. To this end, the pattern and/or density of the mesh 110 may be tailored to provide the desired degree of damping for each associated first opening 90.

Figure 6:
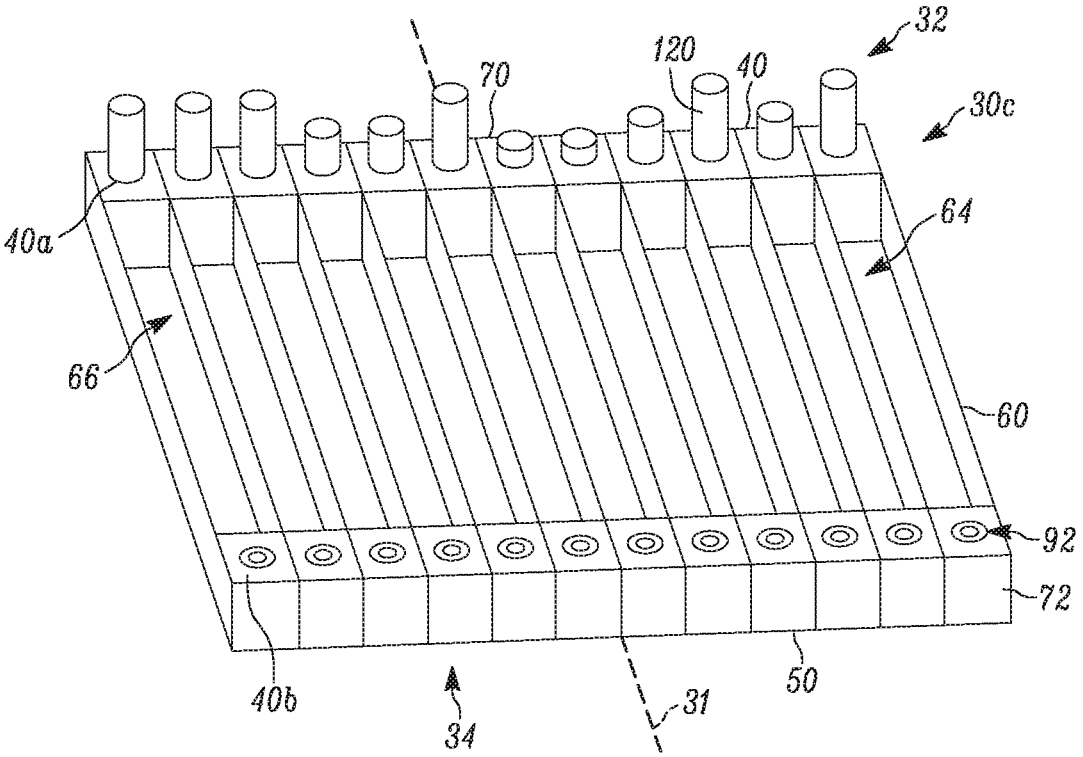
FIG. 6 illustrates the low frequency sound attenuation device of FIG. 2 with necks over some openings.

Referring to FIG. 6, the device 30*c* can alternatively or additionally be provided with tubular necks 120 integrally formed at each first opening 90 or added, e.g., via ultrasonic welding, adhesive or other means of affixation, after the remainder of the device 30*c* is manufactured. The necks 120 change the frequency of each respective chamber 64 and can be used for fine tuning the device 30*c* according to a desired range of frequencies to be attenuated. Thus, each neck 120 can have a particular height extending away from the portion 40*a* of the first sheet 40 to fine tune that specific chamber 64 accordingly.

Any number of the first openings 90 in the device 30*c*, including zero (i.e., no openings), can include a neck 120. Each neck 120 can be the same as or different from every other neck. The mesh 110 when present, can be integrally formed with or secured over an opening of the neck 120. It will be appreciated that the mesh 110 and/or necks 120 can be used in any device described herein.

Figure 7:
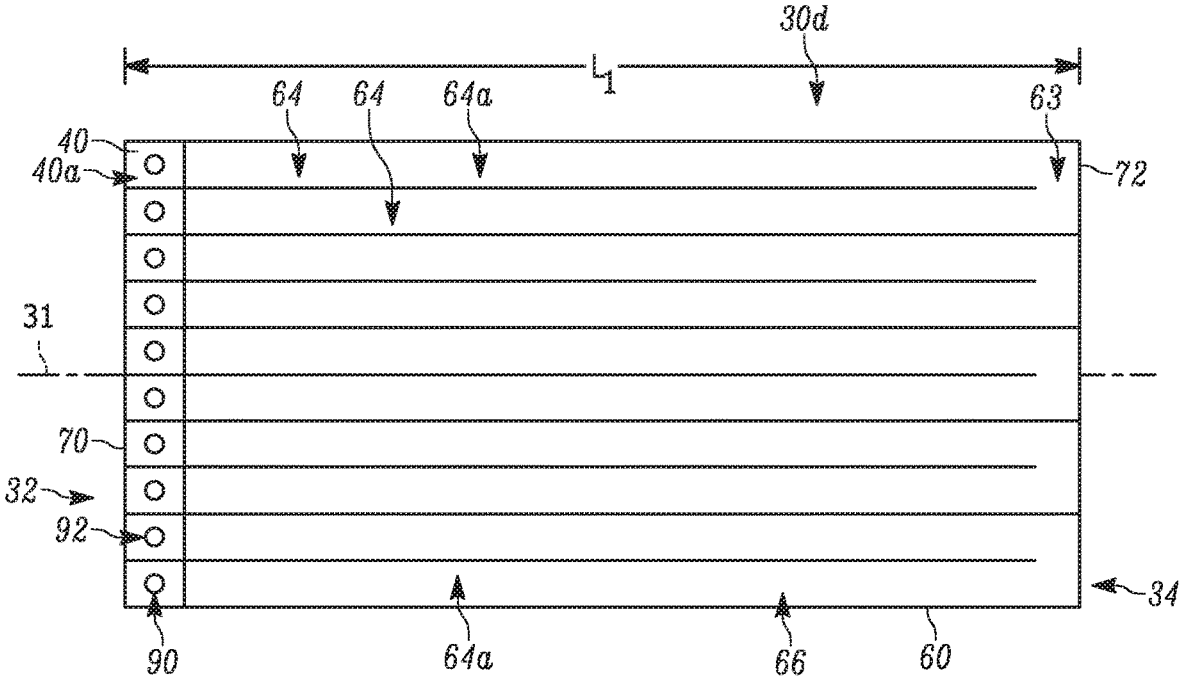
FIG. 7 illustrates another example low frequency sound attenuation device.

Referring to FIG. 7, it is also possible that the device 30*d* can be comprised of an entire single chamber 64 or multiple chambers, i.e., discrete chamber(s) or interconnected chambers extending back and forth between the first and second ends 32, 34. For example, the device 30*d* can include pairs of chambers 64 interconnected by an opening 63 through the wall 60. The pairs of chambers 64 form a larger, U-shaped chamber 64*a* having a cumulative length of $2L_1$. In this configuration, both openings 90, 92 associated with each chamber 64*a* are provided at the same end 32 or 34 of the device 30*d*.

Referring to FIGS. 1-2, the high frequency sound attenuation device 150 extends along a centerline 152 from a first end 154 to a second end 156. The device 150 includes a base 160 and a series of projections 162 extending from the base. As shown, the projections 162 extend perpendicular to the centerline 152. It will be appreciated, however, that the projections 162 could extend parallel or transverse to the centerline 152.

The base 160 has a rectangular shape, with the width extending along the centerline 152. Other shapes for the base 160 are contemplated. The base 160 can have a thickness of, for example, ½". Regardless, the base 160 has the same size and shape as the opening 66 in the device 30 exposing the webs 60. The projections 162 extend lengthwise across the entire base 160. In one example, the projections 162 have a thickness [from the base] of about 2".

Figure 8:
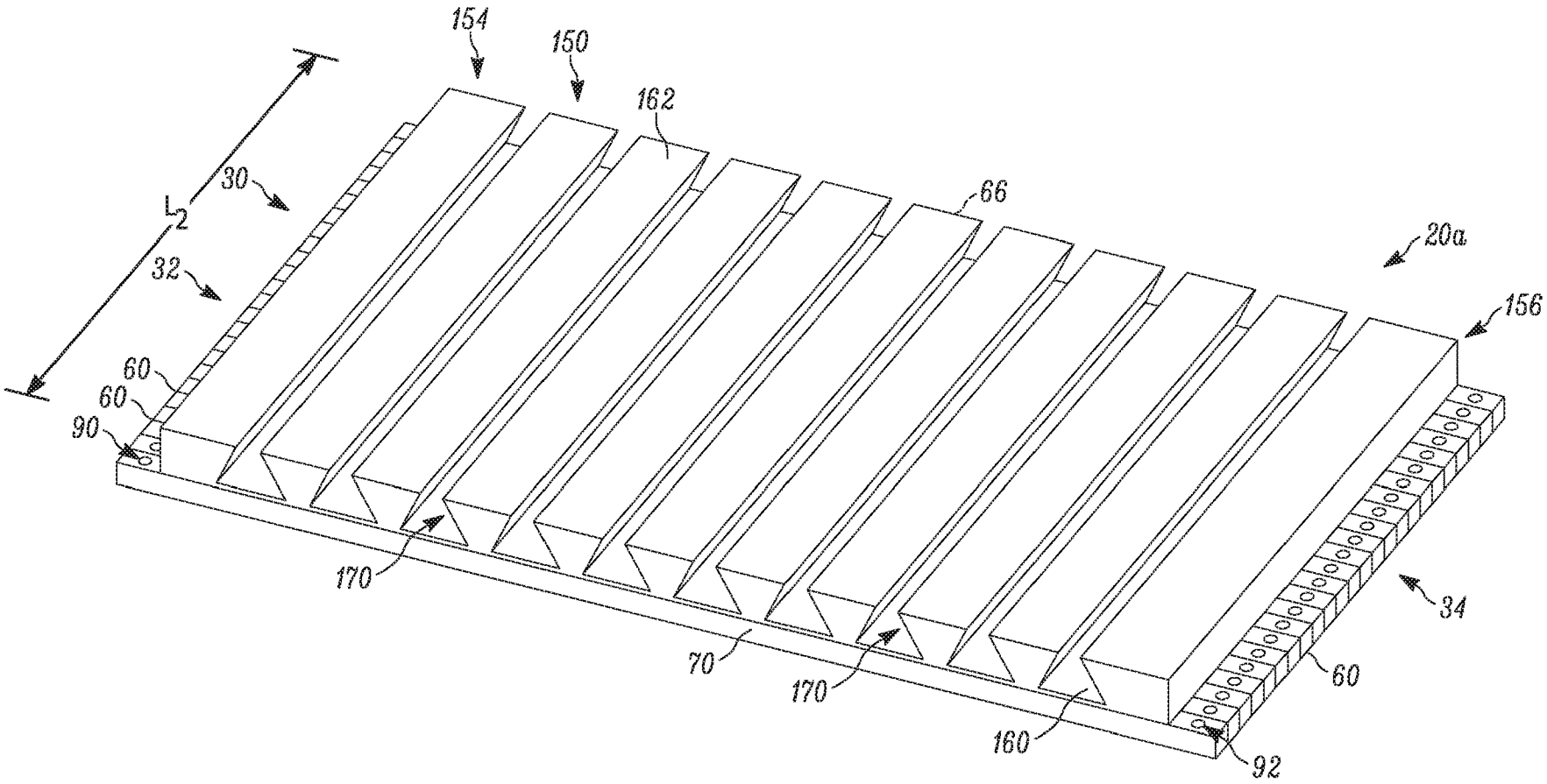
FIG. 8 illustrates an alternative construction of the high frequency sound attenuation device of FIG. 2.
Figure 9:
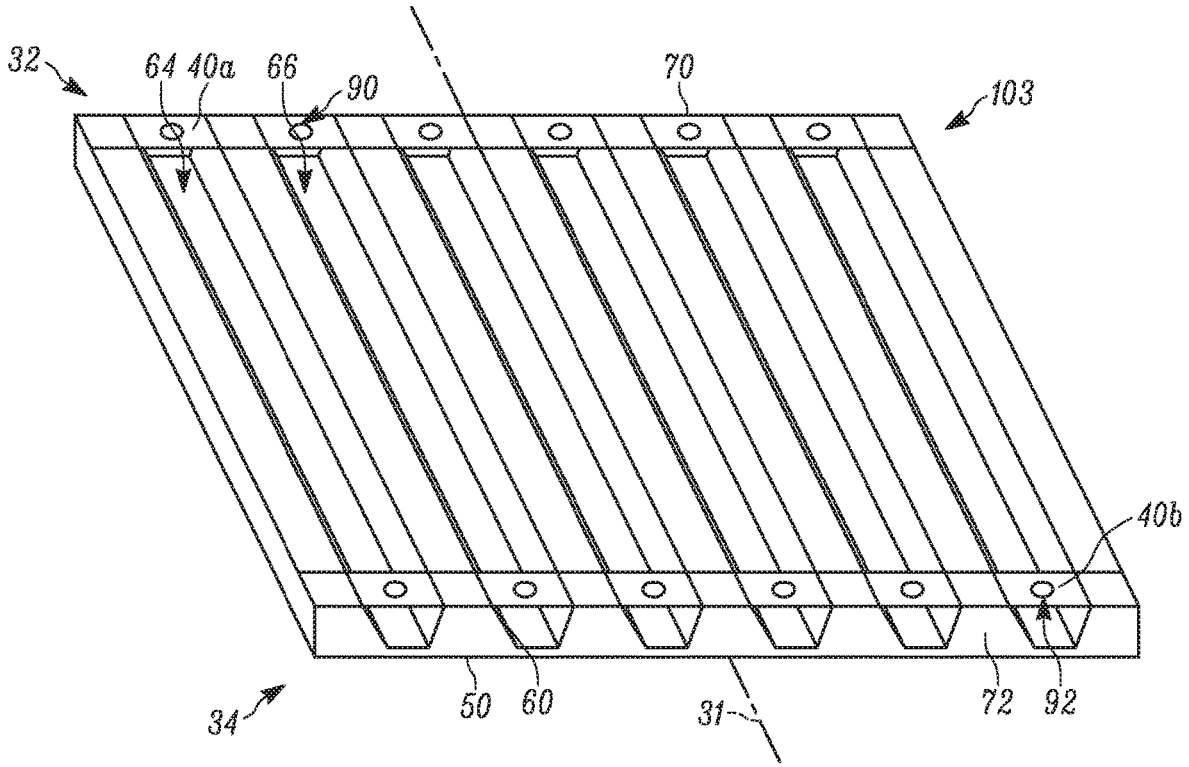
FIG. 9 illustrates an example of a structural panel including a low frequency sound attenuation device.

The projections 162 shown in FIGS. 1-2 have triangular cross-sections. It will be appreciated, however, that the projections 162 could have a different polygonal shapes, e.g., trapezoidal as shown in FIG. 8, T-shaped, etc. The projections 162 can also have curved surfaces and therefore have a shape resembling a half-cylinder (not shown). It will also be appreciated that any projection 162 can have a constant cross-section or a cross-section that varies along its length $L_2$ The projections 162 can all be the same as one another or different from one another. The projections 162 can abut one another (as shown in FIG. 2) or be spaced from one another so as to expose portions of the base 160 (see FIG. 8). Regardless of the specific construction, the projections 162 increase the exposed surface area of the device 150 compared to a device 150 in which the projections are omitted, e.g., a device 150 including only the planar base 160.

A passage 170 extends between each adjacent pair of projections 162. The shape of the projections 162 therefore helps define the shape(s) of the passages 170. Consequently, the passages 170 all have the same size and shape when the projections 162 are all the same. The passages 170 are also defined by the base 160 when the projections 162 are spaced apart. In other words, when a portion of the base 160 extends between and separates the projections 162, that portion of the base cooperates with the spaced-apart projections to define the passage 170.

The device 150 is formed from a sound absorbing material, such as polyurethane foam or a melamine foam composite. The foam can have an open cell or closed cell configuration. The device 150 can have a sound absorption coefficient of, for example, about 0.28-1.51, a noise reduction coefficient of, for example, about 0.70-1.33, and a sound absorption property of, for example, about 25.0-49.3 (Sabins per unit) or about 6.00-19.20 (Sabins per baffle). In one example, the device 150 is formed from an open cell polyurethane foam manufactured by the Acoustics First® Corporation (Richmond, Va.). In another example, the device 150 can be formed from a melamine form composite manufactured by Acoustical Services, Inc. (Chaska, Minn.).

The device 150 acts to mitigate acoustic energy by absorbing excited air molecules passing over/through the device 150. To this end, the projections 162 are configured to provide a predetermined amount of exposed surface area. Increasing the exposed surface area increases the volume of excited air that can be absorbed by the projections 162 as the air passes over/between projections 162. That said, increasing the length $L_2$ of the passages 170 increases the surface area of each projection 162 and therefore increases the volume of excited air that can be absorbed. Each passage 170 has a fixed length $L_2$ and exposed surface area and, thus, the resonant frequency associated with each passage 170 is fixed. Each projection 162 and passage 170 can be contoured so as to be tuned to a specific resonant frequency. In one example, the projections 162 are configured to operate over a frequency range that overlaps the operating frequency range of the device 30.

The exposed surfaces of the projections 162, coupled with any increased flow resistance provided by the projections 162, cooperate to attenuate any acoustic energy striking/interacting with the device 150. More specifically, in addition to absorbing air molecules, the projections 162 can be configured to increase the resistance to air flow through the passages 170, thereby slowing the excited air down to increase the likelihood of absorption into the device 150. In other words, the projections 162 can include curves, edges, and/or contours that impede air flow therebetween to thereby slow the air down. That said, adjusting the exposed surface area of the projections 162 and/or configuration of the passages 170 allows the device 150 to be specifically tailored to attenuate a range of acoustic frequencies. The projections 162 can be configured to define passages 170 that are more conducive to trapping any air entering therein, increasing the likelihood that air will interact with exposed device 150 surfaces and thereby be damped. For example, the more closed the passage 170 perimeter/cross-section, the greater the likelihood that air entering the passage will be absorbed by the device 150.

The device 150 is secured to the device 30 such that the base 160 covers the entire opening 66. For example, securing the device 150 to the device 30 is done in a manner that hermetically seals the interface therebetween. This not only completes a closed boundary around the chambers 64 but also hermitically seals the chambers 64. In other words, the end panels 70, 72, sheets 40, 50, and device 150 are hermetically sealed to one another such that the first and second openings 90, 92 are the only way by which fluid, e.g., air, can enter or exit the device 30.

The device 150 is oriented on the device 30 with the centerlines 31, 152 parallel to one another. The passages 170 in the device 150 therefore extend perpendicular to the chambers 64 in the device 30. Alternatively, the device 150 can be secured to the device 30 such that the passages 170 extend parallel to the chambers 64 (not shown). When the device **30*d* is used in which the openings 90, 92 of the device 30*d* are all located at one end 32 or 34 thereof, the device 150 extends to the opposite end 32 or 34 of the device 30. The openings 90, 92 in the device 30*d* will all be located on one side of the device 150 when the devices 30*d*, 150 are secured together. In any case, the device 150 is secured to the device 30** via adhesive, fastener, etc.

In operation, the assembly 20 is secured to or positioned adjacent an object where sound mitigation is desired. The device 30 mitigates low frequency acoustic noise by utilizing the acoustic chambers 64 and associated openings 90, 92, which act as resonators and allow excited air molecules to vibrate therethrough. The initially stationary air inside of each chamber 64 is excited by a pressure wave and moves outside of the chamber through the associated opening pairs 90, 92. As the air exits, it creates a pressure difference between the inside and outside of the chamber 64, thereby forcing the air to move back inside the chamber section through the respective opening(s) 90, 92. The air continues to vibrate through the openings 90, 92 based upon the chamber's resonant frequency—similar to a tuned mass damper—which dissipates the acoustic energy of the excited air. The chambers 64 are hermetically sealed from one another and, thus, vibrating air within one chamber section does not pass to another chamber section. Rather, the air can only enter or exit each chamber 64 through the respective opening pairs 90, 92.

The device 150 mitigates high frequency acoustic noise, e.g., above about 160 Hz, by absorbing and impeding excited air molecules passing over the device 150. More specifically, the device 150 attenuates airborne sound waves by increasing the air flow resistance, thereby reducing the amplitude of the waves. The material forming the projections 162 is configured to have desired sound absorption properties and, thus, the device 150 is specifically configured to attenuate high frequency sound waves. Consequently, sound waves in the air that come into contact with the device 150—whether through the passages 170 or exposed surfaces of the projections 162—are dampened. The projections 162 can be specifically/individually sized and shaped and, thus, the device 150 is capable of absorbing high frequency sound waves over a wide range.

The assembly 20 described herein can be used in broadband acoustic tube resonator panels, either stand alone or imbedded in structural panels 103 (see FIG. 8—showing only the device 30). These panels 103 can be used on space launch vehicles to provide attenuation for payloads, engine components, or other sensitive equipment. The same broadband attenuation panels 103 can also be used in recording studios, yachts, boats, train cars, as walls/sound dampers in houses and apartment or commercial buildings, and as highway sound barriers. The assembly 20 can also be used for musical instruments where, instead of changing the acoustic length of a tube or having multiple tubes, the instrument can consist of one tube with two openings: one of them fixed in cross-section and the other having a cross-section that is adjustable via the tuning mechanism 97 to a desired frequency.

In lieu of securing the devices 30, 150 together, the assembly 20 can be formed using 3D printing—also known as additive manufacturing. Unlike the structural/acoustic coupled chamber core resonators, additive manufacturing allows the assembly 20 to be readily customized to meet the attenuation and frequency requirements of the particular application and environment without changing the structural design of the device. Using additive manufacturing to produce the assembly 20 therefore provides more design flexibility, a wider usage, and more optimized control in obtaining desired acoustic attenuation requirements. The use of additive manufacturing to produce the device 30 can accommodate low frequency attenuation without requiring the long chambers of current attenuation designs.

Materials that can be used in additive manufacturing to form the components of the device 30 include, but are not limited to, aluminum, brass, copper, tin, lead, magnesium, zinc, titanium, steel, stainless steel, and alloys thereof, ceramics, polymers such as thermoplastics, e.g., polyvinylchloride, and paper. The particular material(s) chosen for each component of the device 30 is based upon desired product requirements and performance criteria. The aforementioned foam materials can be used manufacture the device 150 using additive manufacturing.

Additive manufacturing processes that can be used to form the assembly 20 include, but are not limited to, extrusion, extrusion deposition, granular material binding, lamination, photopolymerization, and binder jetting. The complete device 30 illustrated can be formed entirely by additive manufacturing or by hermitically adhering the end panels 70, 72 to the first and second sheets 40, 50 after the rest of the device 30 has been 3D printed.

The device 30 provides a way to adjust the resonant frequency of the chambers 64 without adjusting the chamber length $L_1$. The cross-section of each second opening 92 can be individually adjusted to provide resonant tuning for the particular chamber 64 that meets desired/required frequency for that particular application. The resonator frequency can be adjusted between the frequency corresponding to the length of the open tube resonator and the frequency corresponding to twice the length of the open tube resonator, or the length of the open-closed tube resonator. Due to this construction, broadband, low frequency attenuators can be manufactured that are less complex and less costly than traditional attenuators having resonators of different lengths. Furthermore, unlike the variable length attenuators described, the device 30 can be adjusted or fine-tuned after being manufactured while maintaining a constant length $L_1$ for all the chambers 64.

The device 30 greatly simplifies the manufacturing process of tube resonator panels. Traditionally, each individual resonator had to be made of a specific length, depending on its frequency. This is challenging for a large number of resonators, both from a logistical and technical standpoint. A resonator panel needs to accommodate two or more resonators per length and multiple resonators per width. Each resonator can, and usually does, have a unique length. Manufacturing such resonators in panels requires applying a series of stops along the length of the panel to separate it from appropriate resonators. Implementing all the resonators dividers at precise locations is time consuming and challenging. Moreover, the frequency of the resonator cannot be changed once the panel is built, eliminating a chance for any necessary corrections should the chamber's length not match the desired resonator frequency.

This device 30 circumvents all the above problems. Using the frequency tuning process described herein, all resonator chambers 64 can have the same length $L_1$, which decreases tooling cost and the logistics of resonator layout design and manufacturing. The frequency tuning mechanism 97 also allows for tuning of the device after it has been manufactured and any/all the resonator partitions 68 set into place. This is accomplished by adjusting the size of the second openings 92 associated with the chambers 64. The in-situ adjustment capability of the devices allows for active tuning that was not possible in previous devices and which significantly improves attenuation and increases the frequency range of the device 30.

An alternate additive manufacturing approach is to fabricate panels by extrusion through a die that has the cross-section of the internal chamber 64. The resulting chambers 64 would have the same cross-section throughout their length $L_1$. The chambers 64 can be made air-tight, or hermetically sealed, by injecting epoxy or any other fluid sealant that would adhere to the sides of the chamber and then harden. Fluid sealant can be injected through any opening 90, 92, 94 or 97 onto a temporary partition that is temporarily hermetically sealed by utilizing a pliable sealant, such as RTV, around the chamber 64 cross-section. Once the epoxy hardens, the temporary partitions can be removed, leaving the chambers 64 comprised of an extruded cross-section partitioned along their lengths $L_1$ using a hardened epoxy. The extruded panel can be composed of various foams, metals, polymers, composites, or any other materials that can be extruded. It will be appreciated that any of the features or constructions shown in the figures can be combined with features in other figures.

Figure 10:
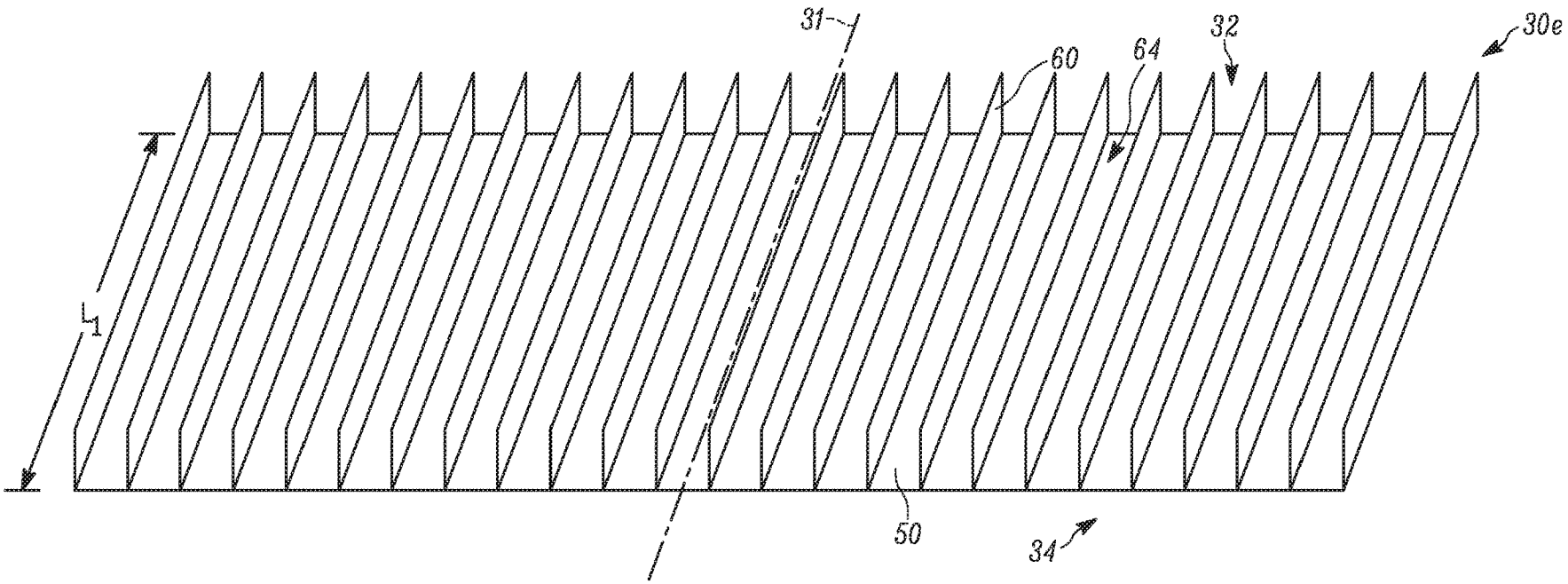
FIG. 10 illustrates a cross section of a low frequency sound attenuation device.

An alternative manufacturing approach is to fabricate a device 30*e* having panels formed by wire cutting to produce chambers 64, as shown in FIG. 10. The resulting chambers 64 would have the same cross-section throughout their length $L_1$. The chambers 64 would be closed along the top by an independently extruded sheet 40 in which the openings 90, 92, 94, 97 would be formed. The chambers 64 can be made air-tight, or hermetically sealed, by providing an epoxy seal (not shown) between the wire cut sheet 50 and webs 60 and independently extruded sheet 40. End panels 70 and 72 (see FIGS. 1-2) can be hermetically adhered to the webs 60 and sheet 50 using epoxy to close the longitudinal ends of the chambers 64.

The chambers 64 can be made air-tight, or hermetically sealed, by injecting epoxy or any other fluid sealant (not shown) into the chamber that would adhere to the sides of the chamber and then harden to create partitions. Fluid sealant can be injected through any opening 90, 92 or 97 onto a temporary partition that is temporarily hermetically sealed by utilizing a pliable sealant around the chamber 64 cross-section. Once the sealant material hardens, the temporary partitions can be removed, leaving the chambers 64 comprised of an extruded cross-section partitioned along their lengths $L_1$. The resulting device 30*e* can be composed of various foams or other materials that can be wire cut.

The device 150 provides a way to adjust the resonant frequency of each projection 162 by adjusting the material, thickness, contour, and adjacent passage 170 configuration. In any case, when the low frequency sound attenuation device 30-30*e* is used in combination with device 150, the assembly 20 has reduced mass and volume as well as reduced fabricating complexity and integration into a single system. Furthermore, due to each of the devices 30, 150 being highly tunable, the assembly 20 allows both full spectrum noise and noise at specific frequencies to be attenuated without changing the complexity of the assembly 20.

What have been described above are examples. It is, of course, not possible to describe every conceivable combination of components or method, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An acoustic attenuation assembly comprising:

a low frequency sound attenuation device including:

at least one sound attenuation chamber containing a volume and mass of air; and first and second openings associated with each low frequency chamber and through which excited air resonates, the first and second openings extending through the first sheet into each low frequency chamber, each chamber having an open side; and a high frequency sound attenuation device secured to the low frequency sound attenuation device and closing the open side of each chamber, the high frequency sound attenuation device including a plurality of projections and being formed from a sound absorbing material that absorbs excited air.

2. The acoustic attenuation assembly of claim 1, wherein passages extend between the projections.

3. The acoustic attenuation assembly of claim 1, wherein the projections have a trapezoidal cross-section.

4. The acoustic attenuation assembly of claim 1, wherein the projections have a triangular cross-section.

5. The acoustic attenuation assembly of claim 1, wherein at least two of the projections have different shapes from one another.

6. The acoustic attenuation assembly of claim 1, wherein the first and second openings for each chamber are positioned on opposite sides of the high frequency sound attenuation device.

7. The acoustic attenuation assembly of claim 1, wherein the first and second openings for each chamber are positioned on the same side of the high frequency sound attenuation device.

8. The acoustic attenuation assembly of claim 1, wherein the sound absorbing material has a sound absorption coefficient of about 0.28 to about 1.51.

9. The acoustic attenuation assembly of claim 1, wherein the sound absorbing material comprises an open-celled foam material.

10. The acoustic attenuation assembly of claim 1, wherein the sound absorbing material comprises an closed-celled foam material.

11. The acoustic attenuation assembly of claim 1, wherein the low frequency sound attenuation device operates over a first frequency range and the high frequency sound attenuation device operates over a second frequency range that overlaps with the first frequency range.

12. The acoustic attenuation assembly of claim 1 further comprising an adhesive for securing the high frequency sound attenuation device to the low frequency sound attenuation device such that each chamber is hermetically sealed.

13. The acoustic attenuation assembly of claim 1, wherein the first openings have an invariable cross-section and at least one of the second openings has an adjustable cross-section for varying a resonant frequency of the chamber.

14. The acoustic attenuation assembly of claim 1, wherein the low frequency sound attenuation device extends along a centerline that is parallel to each chamber, the projections on the high frequency sound attenuation device extending transverse to the centerline.

15. The acoustic attenuation assembly of claim 1 further comprising a frequency tuning mechanism associated with each second opening for adjusting the cross-section of each second opening.

16. The acoustic attenuation assembly of claim 15, wherein the frequency tuning mechanism comprises:

a plurality of leaves; and a controller to change a position the leaves to adjust the cross-section of each second opening.

17. The acoustic attenuation assembly of claim 16, wherein the leaves cooperate to form a shutter, a spacing from a radially inner edge of the leaves to a center of the second opening being variable by the controller.

18. The acoustic attenuation assembly of claim 1, wherein the cross-section of the second openings is adjustable after the acoustic attenuation assembly is fully assembled.

19. The acoustic attenuation assembly of claim 1, wherein at least two of the second openings are different from one another.

20. An acoustic attenuation assembly comprising:

a low frequency sound attenuation device extending from a first end to a second end and comprising:

first and second sheets;

a plurality of webs positioned between the sheets and cooperating with the sheets to form at least one low frequency sound attenuation chamber containing a volume and mass of air, each chamber having an open side;

a first panel secured to the sheets and closing the low frequency chambers at the first end of the device;

a second panel secured to the sheets and closing the low frequency chambers at the second end of the device; and first and second openings associated with each low frequency chamber and through which excited air resonates, the first and second openings extending through the first sheet into each low frequency chamber; and a high frequency sound attenuation device including a plurality of projections, the high frequency sound attenuation device being formed from a sound absorbing material that absorbs excited air, the high frequency sound attenuation device being secured to the low frequency sound attenuation device to close the open side of each chamber.

21. The acoustic attenuation assembly of claim 20, wherein the sound absorbing material comprises an open-celled foam material.

22. The acoustic attenuation assembly of claim 20, wherein the sound absorbing material comprises an open-celled foam material.

* * * * *